United States Patent [19]

Creissels

[11] Patent Number: 4,691,642

[45] Date of Patent: Sep. 8, 1987

[54] MULTICABLE CABLE-CAR OR GONDOLA LIFT

[76] Inventor: Denis Creissels, Allée de la Piscine, 38700 Corenc, France

[21] Appl. No.: 792,891

[22] Filed: Oct. 30, 1985

[30] Foreign Application Priority Data

Nov. 2, 1984 [FR] France ..... 84 16839

[51] Int. Cl.[4] ..... B61B 7/04

[52] U.S. Cl. ..... 104/173.1; 104/112; 104/180; 104/115; 105/148; 198/681; 198/799; 198/803.2

[58] Field of Search ..... 104/89, 93, 173 R, 173 ST, 104/180, 112, 115, 117, 173.1, 173.2; 105/148, 150, 329 R, 329 S, 329 SC, 149.1, 149.2, 329.1; 198/465.4, 681, 799, 803.2

[56] References Cited

U.S. PATENT DOCUMENTS

| | | | |
|---|---|---|---|
| 3,538,855 | 11/1970 | St. Cyr | 104/117 X |
| 3,702,124 | 11/1972 | Highland | 104/112 X |
| 4,473,011 | 9/1984 | Wuschek | 104/173 R |
| 4,509,430 | 4/1985 | Creissels | 104/173 R |

FOREIGN PATENT DOCUMENTS

| | | | |
|---|---|---|---|
| 570284 | 4/1958 | Belgium . | |
| 93680 | 11/1983 | European Pat. Off. | 104/173 R |
| 966765 | 12/1951 | France | 104/112 |
| 1375792 | 9/1964 | France . | |
| 1464478 | 11/1966 | France . | |
| 2453061 | 12/1980 | France | 104/173 R |
| 2501608 | 9/1982 | France . | |
| 2538333 | 6/1984 | France | 104/173 R |
| 517525 | 8/1976 | U.S.S.R. | 105/148 |

*Primary Examiner*—Randolph A. Reese
*Attorney, Agent, or Firm*—Parkhurst & Oliff

[57] ABSTRACT

The cable-car or gondola lift according to the invention comprises two upper cables (10, 12) which laterally frame the upper part of the vehicle (18). The latter bears two support parts (20, 22) articulated on a single horizontal transverse axis of the vehicle (18), each support part being able to be coupled to one of the cables (10, 12). The two cables (10, 12), for example carrier-hauling cables, move in synchronism, the vehicle (18) being able to be detached at the entry to the stations for unloading and loading at a standstill or at reduced speed. The longitudinal stability of the vehicle (18) is ensured by one or more cables staggered in height with respect to the cables (10, 12). According to an alternative embodiment, the longitudinal stability is conferred by the structure of the vehicle (18) itself, in this instance a modular structure.

11 Claims, 10 Drawing Figures

MULTICABLE CABLE-CAR OR GONDOLA LIFT

BACKGROUND OF THE INVENTION

1. Field of the Invention

The invention relates to a multicable transport installation, notably a cable-car or gondola lift having several aerial cables extending along parallel trajectories between two stations to support vehicles or cars travelling between the stations on the line defined by the cables, each vehicle having several support parts which cooperate with said cables.

2. Description of the Prior Art

The use of several cables, notably of two cables arranged in the same horizontal plane, results in a considerable increase in lateral stability and an increased resistance to the action of side winds. In the case of two carrier-hauling cables of the type described in U.S. Pat. No. 4,509,430, a new family of installations has been able to be achieved whose operation is close to that of gondola lifts, the carrying capacity of the cars or vehicles and their stability being comparable to those of cable-cars. These state-of the-art installations, whether they have two carrier cables or two carrier-hauling cables arranged in the same horizontal plane, all use vehicles or cars suspended from the cables by relatively long hanger arms to lower the center of gravity of the vehicle. This hanger arm and the associated support car or cars are complicated, cumbersome elements which considerably increase the gauge of the vehicle and the dimensions of the towers and stations. The purpose of the present invention is to enable a cable-car or gondola lift to be produced with vehicles or cars without hanger arms.

SUMMARY OF THE INVENTION

In the installation to the present invention, the vehicle has no hanger arm and is stabilized in the rolling direction by at least two cables extending laterally on either side of the vehicle, and in the pitching direction by an additional device which compensates for the absence of hanger arms. The two cables, which are either carrier cables or carrier-hauling cables, are arranged on either side outside the vehicle a large distance apart, this spacing being greater than the width of the vehicle. This spacing ensures remarkable transverse stability without requiring a carriage of large dimensions, the support parts being fixed directly to the frame of the vehicle. The vehicle is suspended from the transverse articulation axis of the support parts, and remains in the vertical position independent from the slope of the cables.

It is of course advantageous to increase the longitudinal stability by limiting the pitching movements of the vehicle, notably caused by an irregular distribution of the vehicle load.

According to a first embodiment of the invention, the vehicle is coupled to third cable running at a different height from the two cables at the same level, the third cable being preferably located underneath the vehicle and driven in synchronism with the movement of the vehicle. This arrangement enables the vehicle to be kept in a vertical position by means of the cables and any pitching movement to be prevented or limited. The three cables can be identical carrier-hauling cables, the two upper cables being arranged on either side of the upper part of the vehicle and the third cable being located in the symmetry axis of the vehicle and underneath the floor of the latter, the three cables being driven by a device described further on ensuring perfect synchronism of the movements. It can be understood that rocking of the vehicle, for example a frontwards rocking movement, decreases the tensile force exerted by the lower cable, this unbalance being automatically taken up by an increase in the tensile force of the two upper cables to bring the vehicle back to a vertical position. In the case of an installation with two carrier cables, hauling is advantageously performed by three identical hauling cables two of which are located next to the carrier cables, the third being underneath the car in the longitudinal symmetry plane. The three hauling cables are again driven in synchronism to ensure the stability of the vehicle.

According to a preferred embodiment, the installation comprises four carrier-hauling cables, in this instance two upper cables at the same level on either side of the upper part of the vehicle, and two lower cables at the same level on either side of the lower part of the vehicle. The four cables move in perfect synchronism and give the vehicle remarkable stablity in all directions. The support parts are standard detachable grips actuated on entering the stations by ramps arranged parallel to the trajectory along which the vehicle is moving, these grips bearing sheaves guiding the vehicle in the detachment and attachment area and possibly along the vehicle transfer circuits in the station. Each support part comprises preferably two grips staggered in the longitudinal direction of the associated cable to avoid any slewing of the vehicle due to the action of the tensile forces of the cables. The support parts as well as the cable driving means are of the type described in the previously mentioned U.S. patent to ensure perfect translation of the vehicle.

It can easily be seen that the vehicle is framed and held captive between the support cables and the multiplication of the fixing or attachment points to these cables increases the operating safety of the installation. The positioning, according to the invention, of the cables outside the gauge of the car makes it easy to detach the latter in the detachment areas at the entry to the stations. In the case of four carrier-hauling cables and of the car being detached by a relative upward movement in relation to the cables, the lower support parts are a smaller distance apart than the corresponding upper support parts to facilitate the passage between the upper cables. A reverse arrangement is necessary in the case of the car being detached downwards. It is obvious that the height of the vehicle is considerably smaller than that of standard vehicles with hanger arms, which limits the detachment or attachment movement and makes it possible to install the loading and unloading platforms above the machine room or below the latter if the vehicle is detached downwards. Fitting the stations can be considerably simplified and their size, in particular their length, can be reduced.

According to another embodiment of the invention, the vehicle used is of the modular type well-known to specialists. A vehicle of the kind mentioned comprises several adjacent modules each of which has its own support and cable fixing parts. The modules can make vertical translation movements in relation to one another, these movements being dampened by padding. In a modular vehicle the movements of the passengers are limited and a load shift with respect to the support parts, in the direction of the cables, is limited by the width of the module. The leverage is thus reduced as are the corresponding pitching movements. These vehicles are known to have a great stability, particularly when passing the towers. The load distribution and the relative movement of the modules dampened by the friction padding limit the pitching movements and make an installation possible with two carrier-hauling cables located at the upper part of the vehicle. Such an installation requiring only two carrier-hauling cables is extremely simple, and the drive means can be a bull-wheel with two grooves each taking one of the cables or those of the previously mentioned U.S. patent. Each module comprises a single pair of grips arranged on a single upper transverse axis, in-station running being ensured by roller sheaves. To make curves easier to negotiate the number of sheaves is reduced on one side of the vehicle.

The tops of the towers bear a frame which is advantageously closed and inside which the cable support sheave batteries are fixed. The frame is of larger dimensions than those of the vehicle which is to pass through this frame, the latter automatically taking up the cable in the event of a derailment. It is advantageous to connect the secondary sheave batteries two by two to ensure that they are permanently parallel in a manner described in the previously mentioned U.S. Pat. No. 4,509,430. The sheave batteries are adjustable in height, for example by means of a jack system, ensuring a uniform distribution of the pressures on the sheaves. This uniform distribution contributes to maintaining the synchronism of movement of the cables. The lower sheaves can be slightly staggered with respect to the upper sheaves so that the grips do not reach all the sheaves simultaneously, the same effect being able to be obtained by slightly staggering the support parts fixed to the vehicle.

The cable drive and tension devices are preferably those described in U.S. Pat. No. 4,509,430 or in U.S. patent application Ser. No. 654,657, now U.S. Pat. No. 4,619,206 which have proved themselves, notably the electrical or mechanical drive differential ensuring uniform distribution of the power driving the cables. When braking takes place, synchronism of movement is ensured by coupling, for example of the drive reducer high speed shafts.

BRIEF DESCRIPTION OF THE DRAWINGS

Other advantages and characteristics of the invention will become more clearly apparent from the description which follows of an embodiment of the invention, given as an example only and represented in the accompanying drawings, in which:

In FIG. 1, two carrier-hauling cables 10, 12 of a gondola lift are driven continuously in synchronism by a motor system. The trajectories of the two cables 10, 12 are deduced one from the other by a translation according to an inclined direction in the figure, resulting in both a lateral staggering of the cables and a staggering in height the advantage of which will become apparent from the following. The cables 10, 12 have coupled to them cars or vehicles 18, which are not fitted with the conventional hanger arm to fix them to the cables. A first support and fixing part 20 of a standard coupling grip type, cooperates with the cable 10 which is located on the right-hand side towards the top of the vehicle 18, an identical part 22 cooperating with the cable 12 located on the left-hand side towards the bottom part of the vehicle. Each support part 20, 22 is articulated on an axis 32, 34 transverse to the cables 10, 12 and horizontal, the axes 32, 34 being offset in height in the same vertical plane, which corresponds advantageously to the median transverse plane of the vehicle. The application point R of the tensile and carrying forces of the vehicle 18 is of course in the middle of the straight line joining the cables 10, 12 and this point R is in the longitudinal vertical symmetry plane of the vehicle. It is advisable to place the part 20 at the upper part of the vehicle to move the point R upwards and away from the center of gravity G of the vehicle in order to increase the stabilization effect due to the weight. The position of the part 22 results from a compromise between a high position moving the point R away from the center of gravity G, which favors self-stabilization, and a low position which increases the difference in height of the two parts 20, 22 and increases the pitching stability of the vehicle. The cables 10, 12 frame the vehicle laterally and their wide transverse spacing ensures rolling stability. The staggering of the two cables in height on the other hand enables the vehicle to be stabilized against pitching, it being compulsory that the cables move in synchronism. The operation and special features of this installation will become more clearly apparent from the alternative embodiments of the invention described below.

In FIGS. 2, 3 and 10, an aerial ropeway installation, notably a cable-car or gondola lift, comprises three carrier-hauling cables 10, 12, 14, which extend in a closed loop between two stations only one 16 of which is represented in FIG. 9, the other one being identical or similar. The three cables 10, 12, 14 are parallel, the upper cables 10, 12 being in the same horizontal plane, that is to say that the trajectory of the cable 12 is deduced from that of the cable 10 by a horizontal translation. The third cable 14 is located lower down in the vertical symmetry plane of the upper cables 10, 12. These cables 10, 12, 14 have coupled to them on the line vehicles 18, which travel from one station to the other carried and driven by the three cables 10, 12, 14. The two upper cables 10, 12 frame the upper part of the vehicle 18 laterally, whereas the lower cable 14 is located underneath the vehicle 18. Each vehicle 18 comprises three support parts 20, 22, 24, each of which is associated with one of the cables 10, 12, 14 to secure the vehicle 18 to the corresponding cable. The upper support parts 20, 22 are articulated on the same transverse axis 32, whereas the lower support part 24 is articulated on a lower horizontal transverse axis 34. Each support part 20, 22, 24 is made up of two grips 26, 28 borne by a sheave battery 30 articulated at its mid-point on the axis 32 or 34. The support parts 20, 22, 24 are of the standard type, for example as described in the previously metioned U.S. Pat. No. 4,509,430, and comprise levers 36 actuating the grips 26, 28 to disconnect the vehicles 18 on entering the stations and to reattach them on leaving the latter. Each grip 26, 28 has associated with it a support sheave 38 which can roll on rails 44 (FIG. 9) fitted in the detachment and attachment areas of the stations and possibly along the transfer circuit to guide and bear the support parts 20, 22, 24. As the parallel axes 32, 34 extend in a vertical transverse plane of the vehicle 18, it can eaxily be seen that in normal operation with synchronous movement of the cables 10, 12, 14, the vehicle 18 moves in translation along the line defined by the cables. The upper cables 10, 12 essentially provide the lateral stabilization by limiting the rolling movements of the vehicle 18, whereas the lower cable 14 limits the pitching or rocking movements of the vehicle 18 forwards or backwards by swivelling around the upper axis 32. The three cables 10, 12, 14 are located at the apexes of an isoceles triangle, the upper cables 10, 12 being an equal distance from the lower cable 14. The application point of the tensile force resulting from the three cables 10, 12, 14 is situated at the barycenter R of the isoceles triangle and the assembly is disposed in such a way that this application point of the forces is located notably above the center of gravity G of the vehicle 18. The distance between the points R and G is of course considerably smaller than that of conventional vehicles with hanger arms, but the stability results from the combined effect of the weight and of the holding forces of the cables 10, 12, 14. The wide spacing apart of the two upper cables 10, 12 favors stability of course without requiring a great structure, the support parts being simply articulated on the framework of the vehicle 18. The latter can comprise a transverse frame in the median plane of the vehicle 18 and bearing the three support parts 20, 22, 24. The standard grips 26, 28 can pass over support sheaves 40 or compression sheaves 42 represented by a dashed line in FIG. 2. Sheaves 38, associated with each grip 26, 28, are able to roll on support rails 44 (see FIG. 9) in the stations.

Figure 10:
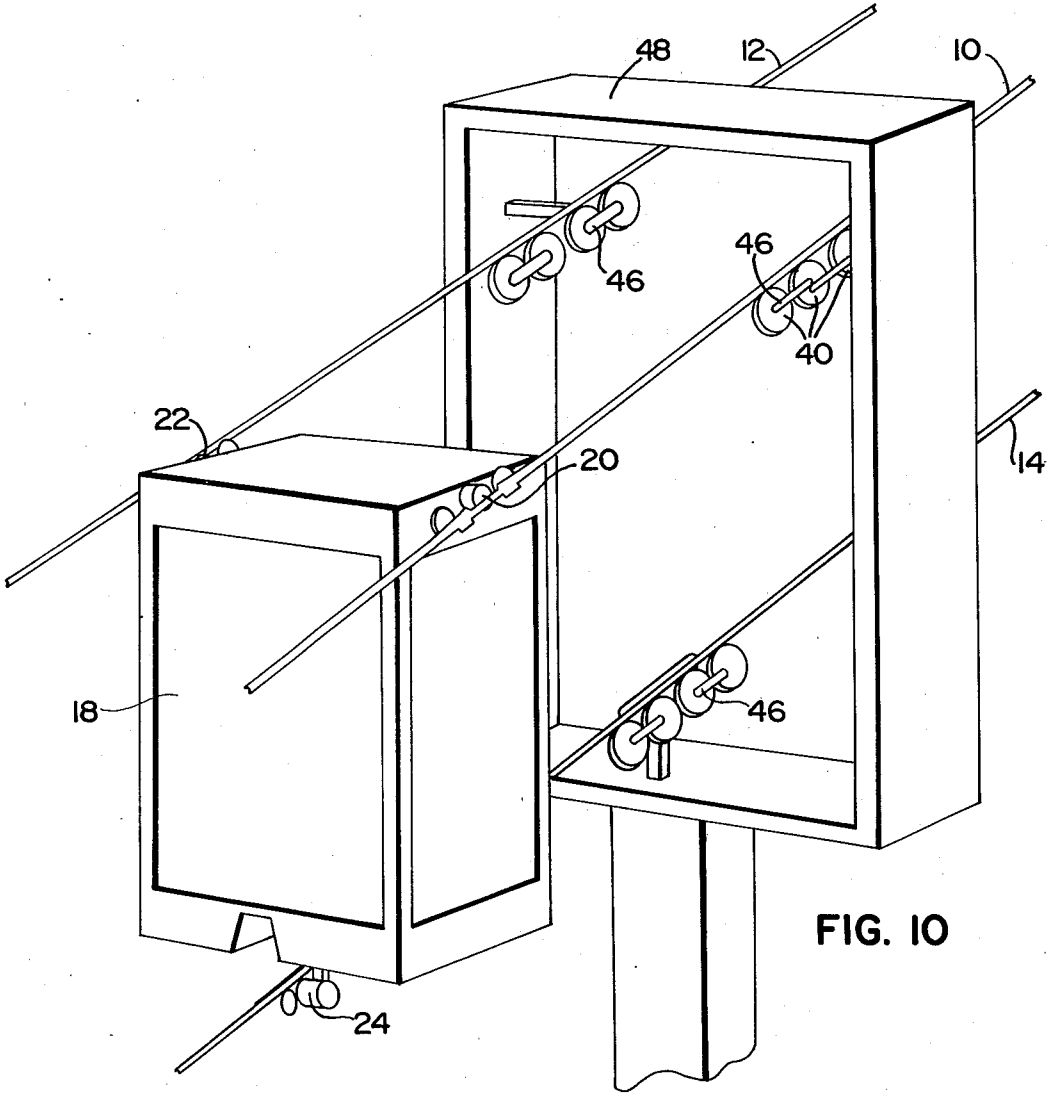
FIG. 10 is a schematic perspective view.

The support sheaves 40 are mounted in batteries 46 supported by tower tops in the form of a frame 48 to support the cables 10, 12, 14. The frame 48 can be a closed frame inside which the cables 10, 12, 14 pass and are held captive, which avoids any risk of their falling in the event of a derailment. The frame 48 is large enough to allow the vehicle 18 to pass through freely coupled to the cables 10, 12, 14. The upper sheave batteries 46 are arranged symmetrically at the same level, whereas the lower battery 46 is preferably slightly staggered longitudinally or in the direction of the cables to avoid the grips passing over all the sheaves simultaneously. This stagger can also be obtained by a slightly staggered fixing of the support part 24 on the vehicle 18 with respect to the upper support parts 20, 22. The sheave batteries 46 are advantageously of the kind described in the previously mentioned U.S. patent and comprise secondary sheave battery fixing brackets to ensure symmetrical swivelling of the corresponding parts. The compression sheaves 42 are arranged in a similar manner on compression sheave batteries which it is pointless describing in detail.

Figure 9:
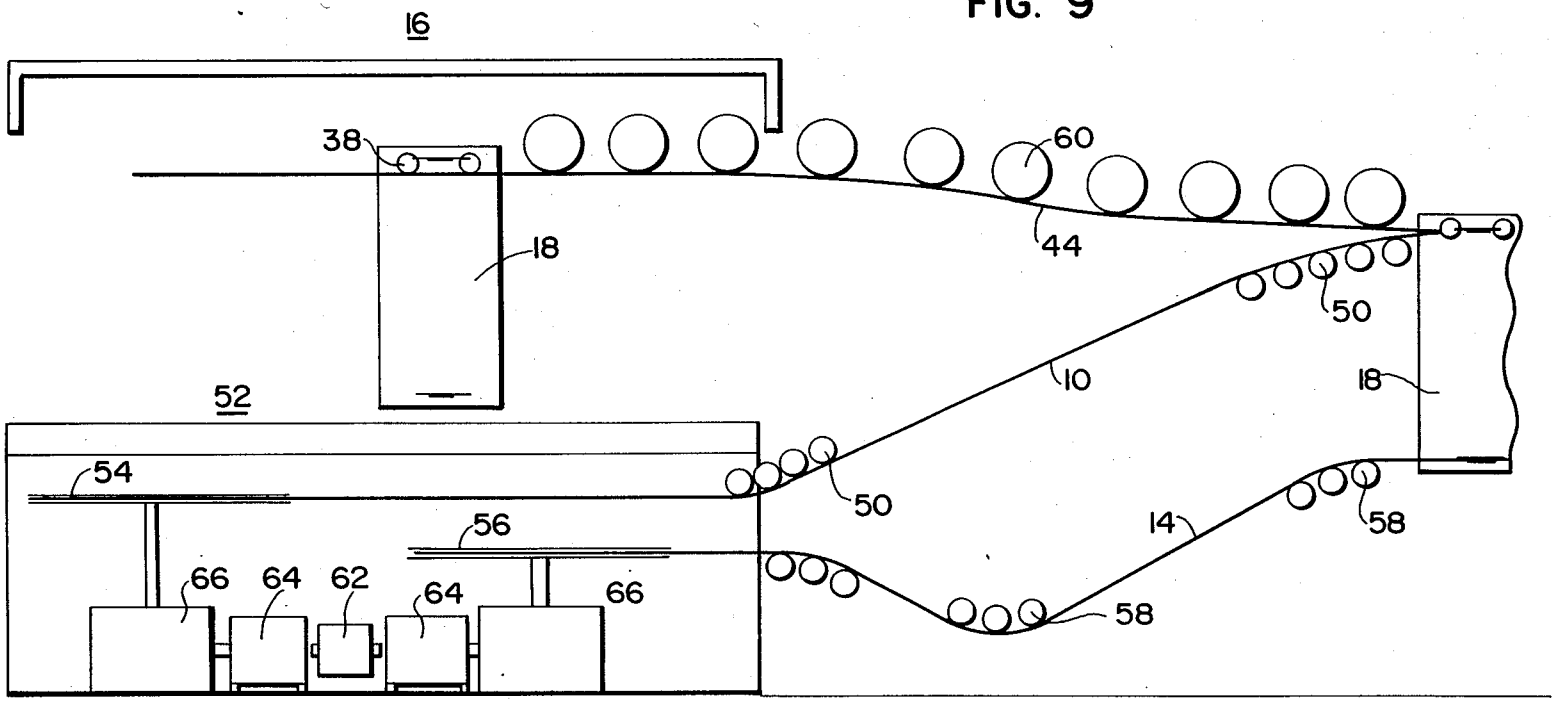
FIG. 9 is a schematic vertical cross-sectional view of a station of the installation according to the invention.

Referring more particularly to FIG. 9, it can be seen that the upper cables 10, 12, of which only the one in the foreground is visible in the figure, are deflected downwards at the entry to the station 16 by sheaves 50 to allow the vehicle 18 to be detached by rolling on a rail 44 and to pass on a platform 52 located above the trajectories of the cables 10, 12, 14. The upper cables 10, 12 run on drive bull-wheels 54, whereas the lower cable 14 runs on bull-wheel 56 and guide sheaves 58, the number of which is equal to the number of sheaves 50 cooperating with each of the upper cables 10, 12, so as to equalize the frictions exerted on the cable 10, 12, 14. The vehicles 18 are driven on the rails 44 in a classical way, either by transfer chains, or by tired wheels 60, spaced out along the trajectory of travel of the vehicles 18. Support and drive of the vehicles 18 detached from the cables 10, 12, 14 in the station can of course be performed in any other way, notably by taking up by carriages or other transporters.

Correct operation of the installation depends on synchronous driving of the three carrier-hauling cables 10, 12, 14. In a similar way to that described in the previously mentioned U.S. Pat. No. 4,509,430, these three cables 10, 12, 14 and their support and drive parts are absolutely identical. They are driven either by identical electric motors supplied by the same current supply via an electrical differential system of the kind described in U.S. patent application Ser. No. 654,657, or by a mechanical differential system schematically illustrated in FIG. 9 by an electric motor 62 driving the bull-wheels 54, 56 via the differentials 64 and reducers 66. The cables 10, 12, 14 are kept under tension by hydraulic jacks or counterweights advantageously located in the opposite station or by any other state-of-the-art operating system.

Operation of this installation is dealt with in the foregoing description and only a brief reminder will be given thereon.

The vehicles 18 are detached from the cables 10, 12, 14 in the stations to enable loading and unloading of the passengers to take place at a standstill or at reduced speed. On leaving the station, the vehicle is engaged via the top between the upper cables 10, 12, for example by running on a sloping rail 44 which at the same time enables the vehicle 18 to accelerate due to gravity. After the speeds of the vehicle 18 and of the cables 10, 12, 14 have been synchronized, the grips 26, 28 are coupled to the three cables 10, 12, 14. The vehicle 18 is driven on the line by these three cables which move in perfect synchronism keeping the vehicle in the vertical position, independent from the slope of the cables. The vehicle 18 is held captive between the cables 10, 12, 14 and presents a very high degree of stability. A large number of vehicles 18 can be spread along the line enabling the installation to have a high carrying capacity. At the entry to the station, the grips 26, 28 are opened in the usual manner and the vehicle 18 is taken up by a rail 44 imposing a relative upward movement detaching the vehicle 18 from the cables 10, 12. The vehicle 18 is taken to the station exit via the loading and unloading platforms to be coupled to the opposite track of the installation. The three cables 10, 12, 14 are identical and pass over the same number of support and guide sheaves, in such a way as to constitute three closed loops or circuits having the same resistance to advance. The differential system driving these cable loops ensures their synchronism of movement and that the vehicle 18 is kept in the vertical position.

Figure 1:
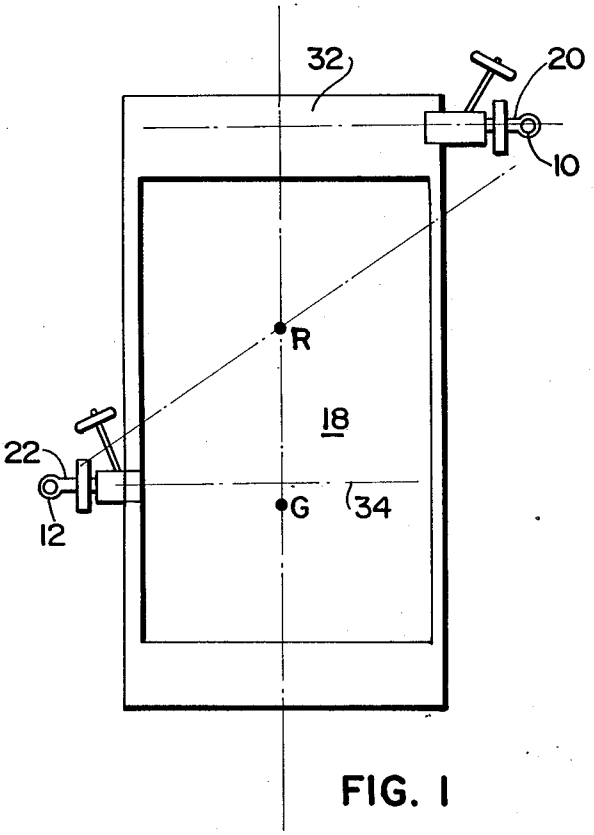
FIG. 1 is a schematic transverse cross-sectional view of an installation according to the invention, with two carrier-hauling cables, staggered in height.
Figure 3:
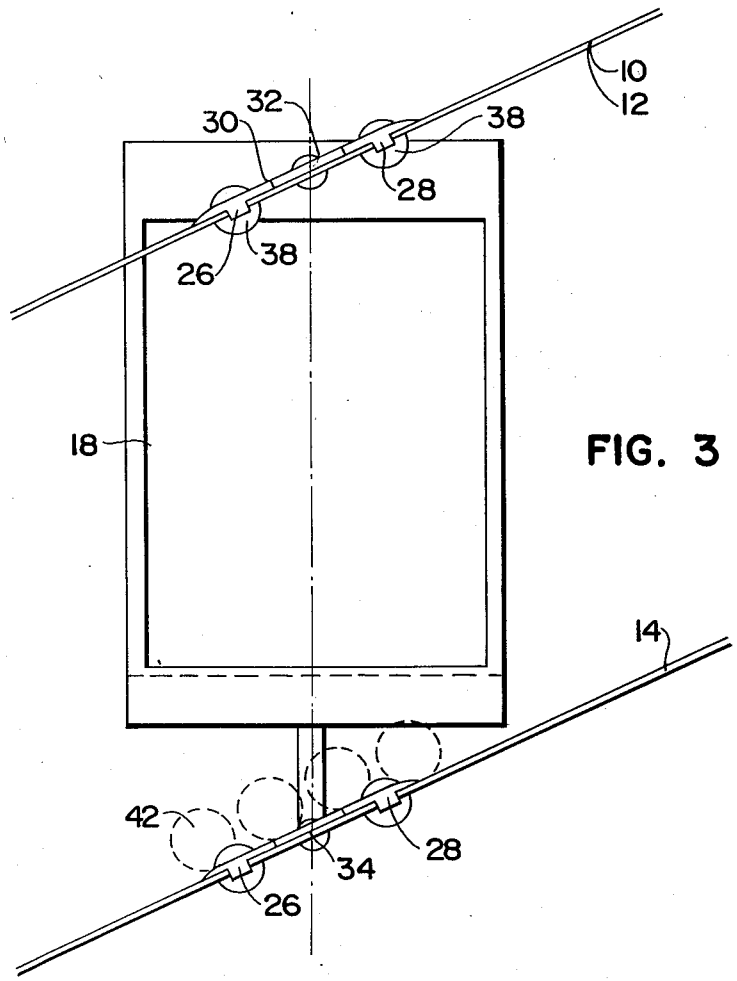
FIG. 3 is a side view of this vehicle.
Figure 2:
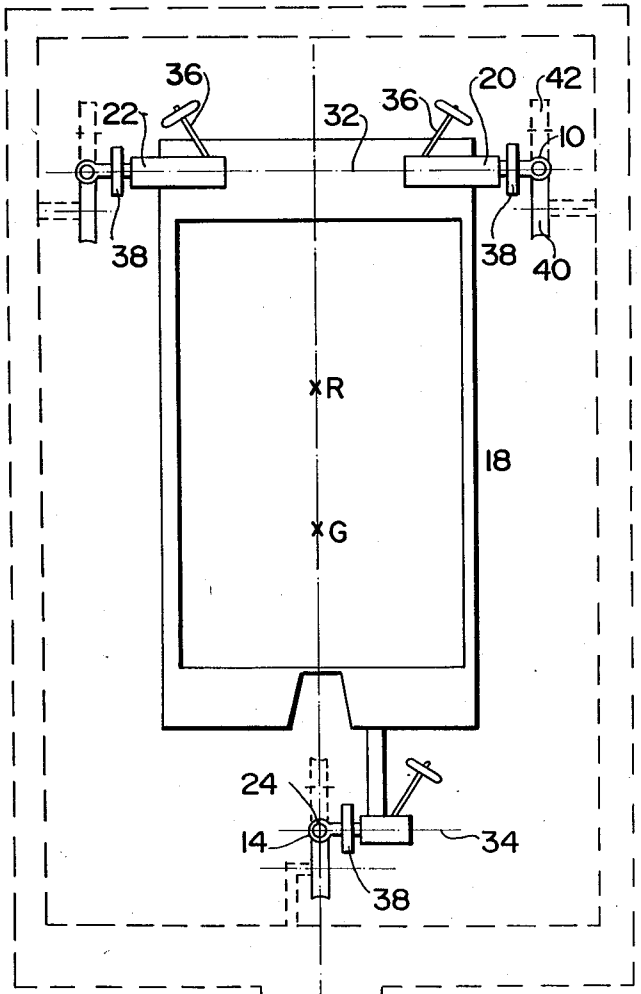
FIG. 2 is a transverse cross-sectional view of a vehicle of an installation with three cables.

Other combinations or alternative embodiments are conceivable some of which are illustrated by FIGS. 4 to 8, in which the same reference numbers designate similar or identical parts to those in FIGS. 1 to 3.

Figure 4:
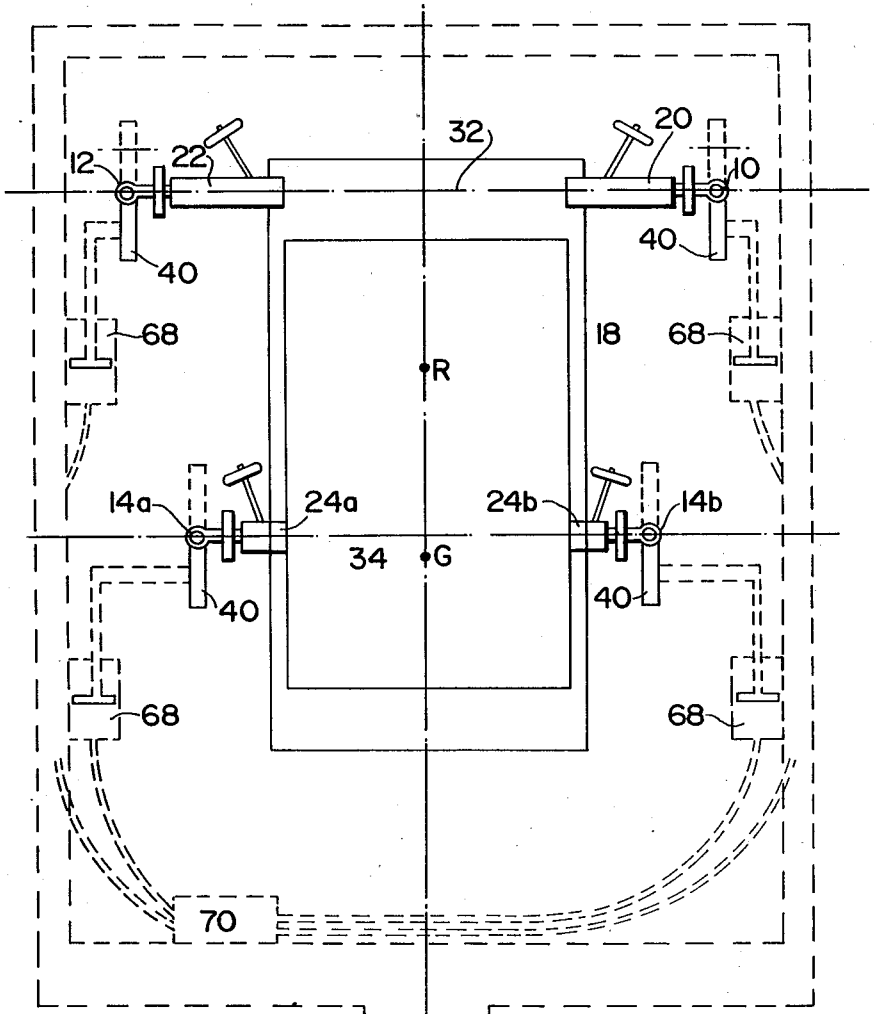

Referring more particularly to FIG. 4, the vehicle 18 can be coupled by two support parts 20, 22 to two upper cables 10, 12. The lower cable 14 is replaced by two cables 14*a*, 14*b* laterally framing the lower part of the vehicle 18. The vehicle 18 has two lower support parts 24*a*, 24*b* articulated on the same horizontal transverse axis 34 and cooperating respectively with the cables 14*a* and 14*b*. The four cables 10, 12, 14*a*, 14*b* are identical carrier-hauling cables driven in synchronism, and it can easily be seen that the vehicle 18 remains in the vertical position whatever the incline of the cables. In the example illustrated by FIG. 4, the distance between the upper cables 10, 12 is slightly greater than that between the lower cables 14*a*, 14*b* to enable the vehicle 18 to be detached in the detachment area of the station via the top without deviating the cables 10, 12. In an installation where the vehicle 18 is detached downwards, a reverse arrangement with a greater distance between the lower cables 14*a*, 14*b* is used. The cables 10, 12, 14*a*, 14*b* can of course be the same distance apart on the line, being deviated in the stations to enable the vehicle 18 to be detached. The stability increases with the distance the cables are apart, notably the distance the lower cables 14*a*, 14*b* are from the upper cables 10, 12, and it is conceivable to arrange the four cables 10, 12, 14*a*, 14*b* at the four corners of the vehicle 18, this solution however having the drawback of situating the application point R of the resultant of the forces closer to the center of gravity G and of lowering the autostabilization due to the weight. The solution results from a compromise depending on the characteristics of the vehicle and of the installation. The friction of the sheaves 40 depends on their load and it is important that this load be spread evenly on the sheaves 40 of the batteries. FIG. 4 shows a hydraulic jack device 68 each supporting one of the sheave batteries 46 and supplied by the same pressure source 70. The jacks 68 enable the sheave batteries 46 to be adjusted in height and the loads to be spread evenly. Any other automatic adjustment system, notably by means of springs, can be used. Operation of the installation according to FIG. 4 is absolutely identical to that described above for a transport installation with three carrier-hauling cables.

Figure 5:
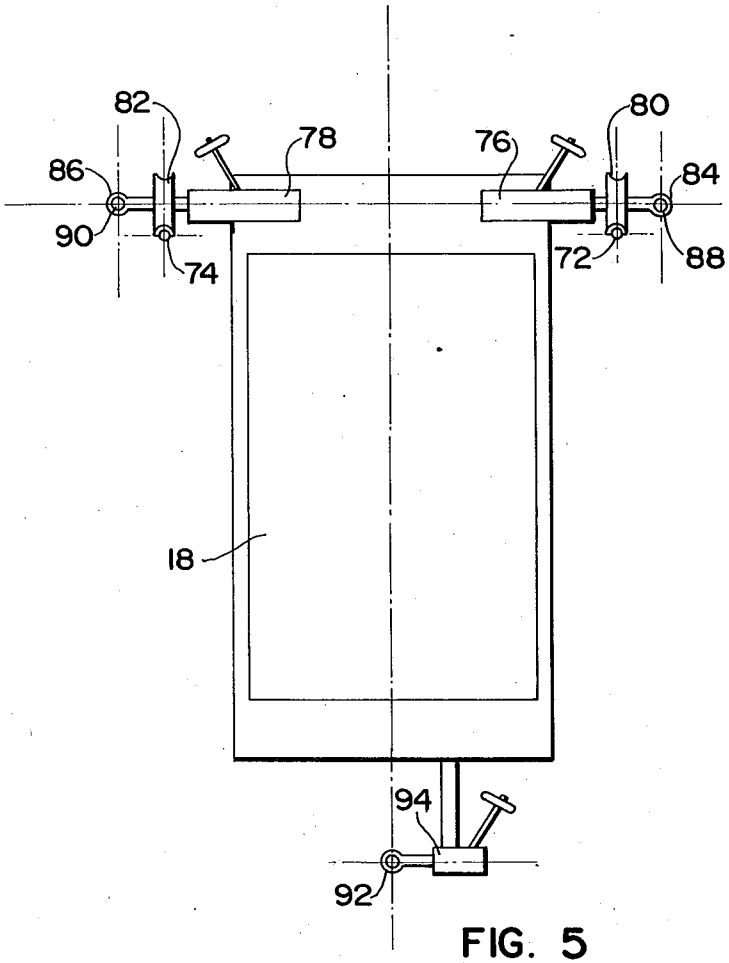
FIGS. 4 and 5 are similar views to FIG. 2, illustrating two alternative embodiments according to the invention.

FIG. 5 illustrates an alternative embodiment using carrier cables 72, 74 separate from the hauling cables. The two carrier cables 72, 74 frame the upper part of the vehicle 18, extending in the same horizontal plane. Each vehicle 18 has two upper support parts 76, 78 bearing roller sheaves 80, 82 which run on the carrier cables 72, 74 and coupling grips 84, 86 to clamp on two hauling cables 88, 90 adjacent to the carrier cables 72, 74. The third hauling cable 92 extends below the vehicle 18 and cooperates with a coupling grip 94 borne by the floor of the vehicle 18. The three hauling cables 88, 90, 92 are identical and are driven by a differential system of the type described above ensuring their synchronism of movement. It can be seen that transverse oscillation movements are essentially limited by the two carrier cables 72, 74, whereas longitudinal oscillations of the vehicles 18 corresponding to pitching are controlled by the hauling cables 88, 90, 92 in the same way as that described for carrier-hauling cable installations according to FIGS. 1 to 3. The number of hauling cables can of course be different, two cables being a minimum number, these two cables being staggered in height and located in the longitudinal symmetry plane of the vehicle 18. It is obvious that such an installation particularly advantageous for continuous running of the vehicles 18 can be used in to-and-fro mode in which case the grips 84, 86, 94 are replaced by fixed clamps.

Figure 7:
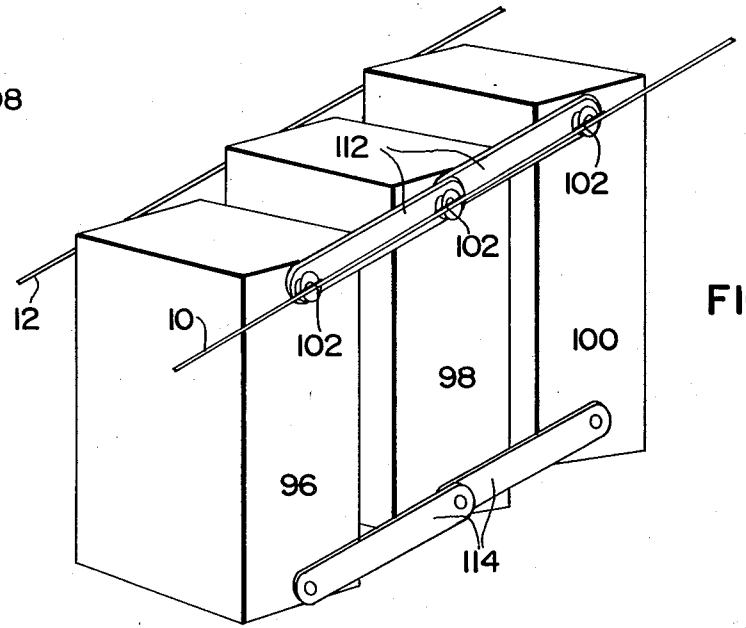
FIG. 7 is a schematic perspective view of the vehicle according to FIG. 6.
Figure 8:
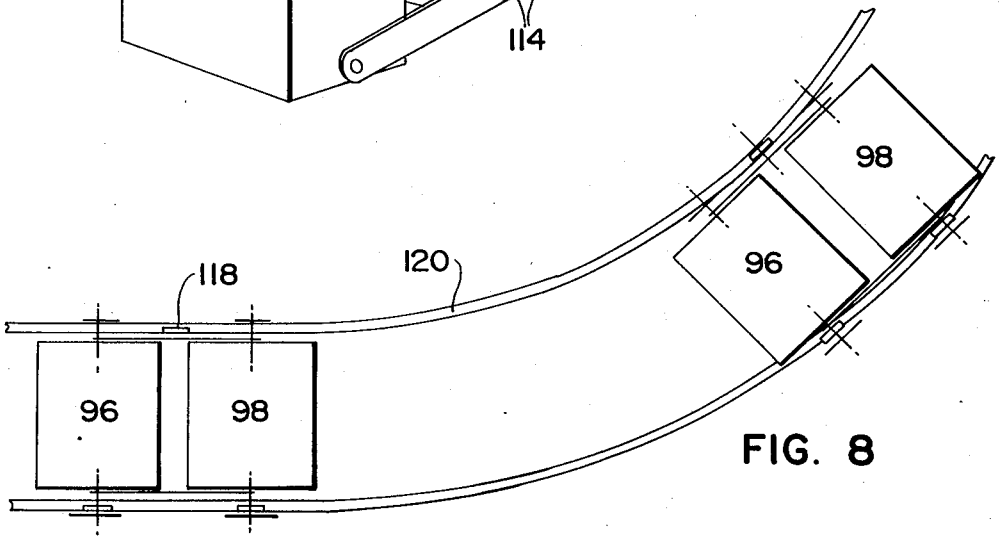
FIG. 8 is a plan view, illustrating running of a modular vehicle in a station.
Figure 6:
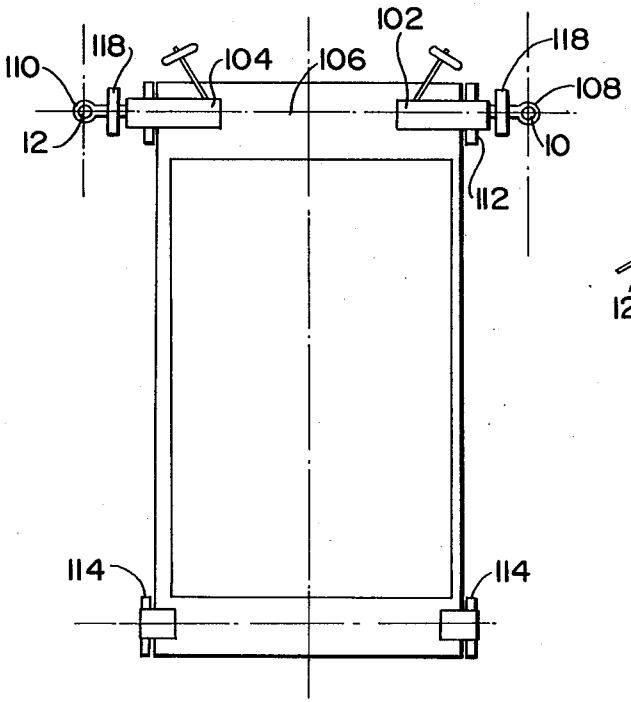
FIG. 6 is a transverse cross-section of a modular vehicle according to an alternative embodiment of the invention.

Referring to FIGS. 6 to 8, the two carrier-hauling cables 10, 12 can be seen framing the upper part of a modular type vehicle 18 made up of three identical adjacent modules 96, 98, 100. Each module 96, 98, 100 has two support parts 102, 104, articulated on a single horizontal transverse axis 106 and each bearing a grip 108, 110 for attachment to the cables 10, 12. Depending on the slope of the cables 10, 12, the modules 96, 98, 100 adjust their height in relation to one another coming closer or moving apart, the modules 96, 98, 100 being practically in contact on the sections having the highest gradient. In the example illustrated by FIG. 7, the modules 96, 98, 100 are connected at their upper part by articulated connecting rods 112 extending parallel to the cable 10 held captive in the grips 108, 110 and at their lower part by parallel connecting rods 114 articulated on the modules. The connecting rods 112, 114 keep the modules 96, 98, 100 parallel to one another permanently, any other connecting system being able to be used. The carrier-hauling cables 10, 12 are driven in synchronism in the manner described above, the vehicle being detached in the station by opening of the grips 108, 110 or remaining attached to these cables in the case of an installation with to-and-fro running of the vehicles. The large distance apart of the carrier-hauling cables 10, 12 provides the vehicle 18 with an especially remarkable transverse stability, a third cable, staggered in height, being in no way indispensable due to the stability inherent to the modular structure of the vehicle 18. This stability to longitudinal oscillations, in this instance pitching of the vehicle 18, is explained by the small width of each module 96, 98, 100, which limits the load shift in relation to the suspension point. The vertical stagger of the modules 96, 98, 100 resulting from a longitudinal oscillation causes in addition friction of the pads playing the role of dampers between the modules 96, 98, 100. This great stability is confirmed by the small oscillations of standard modular vehicles when passing the towers. Doing away with the hanger arms of the different modules simplifies the installation notably while at the same time reducing its dimensions. The stations and towers are of course identical to those described above, the modular vehicle being quite easily able to be used in combination with a three or four carrier-hauling cable or separate carrier cable and hauling cable system. The support parts 102, 104 bear roller sheaves 116, 118 which can roll on rails 120 in the stations. To make curves easier to negotiate, each vehicle 18 is advantageously supported by three roller sheaves only, a single sheave 118 being for example on the side of the rail on the inside of the curve. Other modes of running the vehicles 18 in the station can of course be conceived and used.

Eliminating the hanger arm opens the way for a new family of aerial ropeway installations which bear a closer resemblance to railway systems and which can advantageously replace the latter in certain applications.

I claim:

1. Multicable passenger transport installation, notably a cable-car or gondola lift, having several aerial cables extending along parallel trajectories between two stations having loading and unloading platforms, comprising:

several vehicles or cars without hanger arms moving between the stations on the line defined by the cables, at least two pivots borne by each vehicle and extending horizontally and transversely to the longitudinal direction of the cables, two of said cables exending laterally along each vehicle being spaced apart transversely in relation to the direction of the cables and being spaced apart in height, the trajectories of said two cables being deduced one from the other by translation, support parts pivotally mounted on said pivots for free movement in a vertical plane, two grips, one borne by each of said support parts for coupling to the cables to move each vehicle on the line, the vehicles being stabilized in the rolling direction by the laterally spaced cables, a device driving said two cables in synchronism to stabilize the rocking and the pitching of the vehicles driven in translation, to compensate for the absence of hanger arms.

2. Installation according to claim 1, wherein said cables are carrier-hauling cables to which each vehicle is coupled by said two grips which are detachable in the station, each cable forming an endless loop between the two stations, said carrier-hauling cables all being driven in synchronism to impose a translation movement of the vehicle along the line.

3. Installation according to claim 1, comprising three carrier-hauling cables located at the three apexes of an isoceles triangle, the two upper cables at the same level corresponding to the apexes having the same angle, the third cable extending in the symmetry plane underneath the vehicles.

4. Installation according to claim 1, wherein said cables comprise a plurality of carrier-hauling cables, two among said plurality of carrier-hauling cables being located at the same level and laterally framing the upper part of the vehicles to provide the rolling stability of the vehicles and at least two among said plurality of carrier-hauling cables moving in synchronism and being staggered in height in relation to one another to provide the pitching stability.

5. Installation according to claim 1, comprising two upper carrier-hauling cables located at the same level and laterally framing the upper part of the vehicles and two lower carrier-hauling cables located at the same level and laterally framing the lower part of the vehicles, wherein each vehicle has four support parts articulated two by two respectively on two pivots aligned on an upper transverse axis and two pivots aligned on a lower transverse axis, the two axes being in the same vertical plane.

6. Installation according to claim 5, wherein the vehicle support parts are detachable grips to detach the vehicles from the cables in the station, said stations having transfer rails to take the vehicles up and to impose a relative vertical upward or downward movement on the vehicles so as to disengage the vehicles from the cables, and the upper cables are a greater distance apart than the lower cables when the vehicles are disengaged upwards and vice-versa.

7. Installation according to claim 1, wherein each support part comprises two detachable grips staggered in the longitudinal direction of the cable and a sheave battery articulated at its mid-point on the vehicle and bearing the two grips, and roller sheaves which roll on support and guide rails in the detachment and attachment and/or transfer areas in the stations.

8. Installation according to claim 1, wherein hauling cables run in the station on bull-wheels, electric motors driving each of said bull-wheels, all the motors being identical and supplied by a single current source, and a mechanical or electical differential system ensuring uniform distribution of the driving power among the different cables to maintain synchronous movement of the cables.

9. Installation according to claim 8, wherein the bull-wheels driving the hauling cables are located in the stations under the platforms, the vehicles detached from the cables being disengaged from the cables and engaged between the cables respectively by a relative upward and downward movement to pass from the cables to the platform and vice-versa.

10. Installation according to claim 1, wherein said cables comprise a plurality of carrier-hauling cables, two among said plurality of cables being spaced apart transversely in relation to the longitudinal direction of the cables to stabilize the vehicles in the rolling direction, and at least two among said plurality of cables being staggered in height and driven in synchronism to stabilize the vehicles in pitching, the pitching stabilization cables being able to be the same cables as the rolling stabilization cables.

11. Multicable passenger transport installation, notably a cable-car or gondola lift, having several aerial cables extending along parallel trajectories between two stations having loading and unloading platforms, comprising:

several vehicles or cars without hanger arms moving between the stations on the line defined by the cables, at least two pivots borne by each vehicle and extending horizontally and transversely to the longitudinal direction of the cables, two of said cables extending laterally on either side of the vehicles being spaced apart transversely in relation to the direction of the cables, the trajectories of said two cables being deduced one from the other by translation, support parts pivotally mounted on said pivots for free movement in a vertical plane, two grips, one borne by each of said support parts for coupling to the cables to move each vehicle on the line, the vehicles being stabilized in the rolling direction by the laterally spaced cables, a device driving said two cables in synchronism to stabilize the rocking of the vehicles driven in translation, each vehicles further comprising several separate modules each having support parts for coupling to said cables, the modules being spaced in the direction of the cables and touching one another when the vehicle passes over the line sections having the greatest slope, the modules being arranged to allow a relative vertical movement of one module in relation to the adjacent module, imposed by the slope variations of the line, each module being coupled to said two cables by two support parts pivotally mounted on two pivots aligned on a transverse axis of the module, said two cables framing the upper part of each module, the vehicle further comprising articulated connecting rods between the modules to keep the modules parallel with one another.

* * * * *